United States Patent [19]

Tippmann

[11] Patent Number: 4,632,787

[45] Date of Patent: Dec. 30, 1986

[54] EVAPORATIVE HEAT EXCHANGER

[76] Inventor: Robert T. Tippmann, 9837 St. Joe Rd., Fort Wayne, Ind. 46815

[21] Appl. No.: 792,925

[22] Filed: Oct. 30, 1985

[51] Int. Cl.[4] ..... B01F 3/04

[52] U.S. Cl. ..... 261/30; 165/60; 165/900; 261/109; 261/112; 261/153; 261/DIG. 11; 261/DIG. 86; 416/193 R; 416/203

[58] Field of Search ..... 261/30, 88, 109, 111, 261/112, 153, DIG. 77, DIG. 11, DIG. 86; 159/13.4; 165/60, 900; 416/193, 203

[56] References Cited

U.S. PATENT DOCUMENTS

| | | | |
|---|---|---|---|
| 1,991,194 | 2/1935 | Child | 416/193 |
| 2,672,328 | 3/1954 | Mart et al. | 261/DIG. 11 |
| 3,148,516 | 9/1964 | Kals | 165/900 X |
| 3,385,352 | 5/1968 | Engalitcheff, Jr. et al. | 159/13.4 X |
| 3,500,615 | 3/1970 | Meek | 261/DIG. 11 |
| 3,635,589 | 1/1972 | Kristiansen | 416/193 |
| 3,865,911 | 2/1975 | Lefevre | 261/DIG. 77 |
| 4,273,733 | 6/1981 | Kals | 261/153 X |
| 4,476,065 | 10/1984 | McKey | 261/153 X |

FOREIGN PATENT DOCUMENTS

| | | | |
|---|---|---|---|
| 81664 | 6/1983 | European Pat. Off. | 261/DIG. 11 |

*Primary Examiner*—Richard L. Chiesa
*Attorney, Agent, or Firm*—Joseph J. Baker

[57] ABSTRACT

A heat exchanger is disclosed having a coil positioned between an outer casing member with a bottom having a sump formed therein and an inner casing member containing a rotatable shaft to which a fan is mounted. The fan has a first stage or set of blades which pushes air from the outside down over the coils and a second stage or set of blades having a pitch opposite the first set for pulling the air up through the inner casing member to exhaust. A distributor having a pump which operates on centrifugal force is also provided which draws a liquid heat transfer medium preferably water from the sump and rotates with the fan blades to effectively "sling" the medium over the coils as the fan rotates.

11 Claims, 5 Drawing Figures

EVAPORATIVE HEAT EXCHANGER

BACKGROUND OF THE INVENTION

The present invention relates to heat exchangers and more particularly to one of the evaporative type having an improved, more efficient, air circulation and water distribution means.

U.S. Pat. No. 3,385,352 is typical of prior art heat exchangers or condensers in that it employs a fan having blades of identical pitch which are rapidly rotated to draw air from the outside down over and through the coils and up past the fan blades to exhaust. At the same time water is drawn from a sump by a centrifugal pump rotated with the fan blades and deposited into a trough above the coils from which it flows down over the coils by gravity. The efficiency of these prior art exchangers was relatively low due primarily to the large amount of electrical power required to rotate the fan blades sufficiently fast to insure necessary air flow over the coils for proper heat transfer. In addition, dripping of the water over the coils did not result in a sufficient amount of the surface area of the coils coming in contact with the water. For comparison, a typical evaporator of the prior art which requires a 40,000 cubic feet per minute air flow at a one-half inch static air pressure would need a fifteen horsepower motor to drive a plurality of fans at approximately 1750 rpm and approximately three additional horsepowers would be required to operate the water distribution pump. In contrast, as a result of Applicant's unique two-stage (pushing and pulling) fan blade design and sling-type water distribution system, significant power savings can be realized while achieving the same amount of cooling. Applicant's design requires only a one and one-half horsepower motor to rotate a single large, two stage fan at approximately 100 rpm to thereby achieve the same 40,000 cubic feet per minute rate of flow at a one-eight inch static air pressure and only one-fourth additional horsepower would be required to operate the water distribution pump due to its unique design. This reduced static pressure results from the fact that the water and air move in the same direction unlike prior art evaporators.

Applicant achieves this phenomenal efficiency by his unique two-stage fan blade design which requires a fraction of the horsepower needed by the prior art evaporators to circulate the same quantity of air through the cooling coils. Applicant's fan relies on the well known fact that on a typical fan blade, 80 percent of the work is done by the outer end 20 percent of the blade. Thus, by mounting the fan blades for rotation above both the air inlet to the coils, as well as the outlet from which the air is being exhausted and having the first stage or outer approximately 20 percent of the fan blades pitched to force air into the inlet and the second stage or inner approximately 80 percent of the fan blades pitched in a direction opposite to those of the first stage to draw this air out the exhaust outlet, a large quantity of air can be circulated over the coils by rotating these blades slowly in comparison to similar fans of the prior art devices. Applicant's unique blade design will be more fully explained later. In addition, Applicant's device can constantly distribute cooling water or other liquid heat transfer medium such as glycol brine or the like, over the coils as the fan blades rotate. This is achieved by a novel pump which relies on centrifugal force to withdraw water from a sump and in effect "sling" it over the coils as the pump rotates with the fan blades. Air forced by the fan blades of the first stage engages this cooling water and insures complete distribution over the coils while simultaneously reducing the static air pressure in front of the fan blades of the first stage as aforementioned.

It is therefore the primary object of the present invention to provide an improved and highly efficient heat exchanger.

It is another object of the present invention to provide a device of the subject type which utilizes a novel two-stage (push and pull), slow moving, fan blade arrangement having two sets of blades to achieve air flow through the device.

It is a further object of the present invention to provide a device of the subject type that has incorporated in it a more efficient pump that acts to "sling" the water over the coils as the fan blades rotate in the same direction as the pump.

It is yet another object of the present invention to provide a device of the subject type that, due to its simple construction and use of materials that do not easily corrode or deteriorate from exposure to the elements, is relatively less expensive to operate and maintain than similar prior art devices.

These and other objects and advantages of the present invention will become more apparent upon consideration of the following detailed description taken in conjunction with the drawings wherein:

FIG. 1 is a side elevational view in partial cross-section of the evaporative heat exchanger device of the present invention, FIG. 2 is a plan view of the device shown in FIG. 1, FIG. 3 is a view partly broken away taken along the lines 3—3 of FIG. 2, FIG. 4 is a perspective view of the fan blade of the present invention, and, FIG. 5 is a partial, side elevational view of another embodiment of the present invention.

DETAILED DESCRIPTION OF PREFERRED EMBODIMENTS

Figure 1:
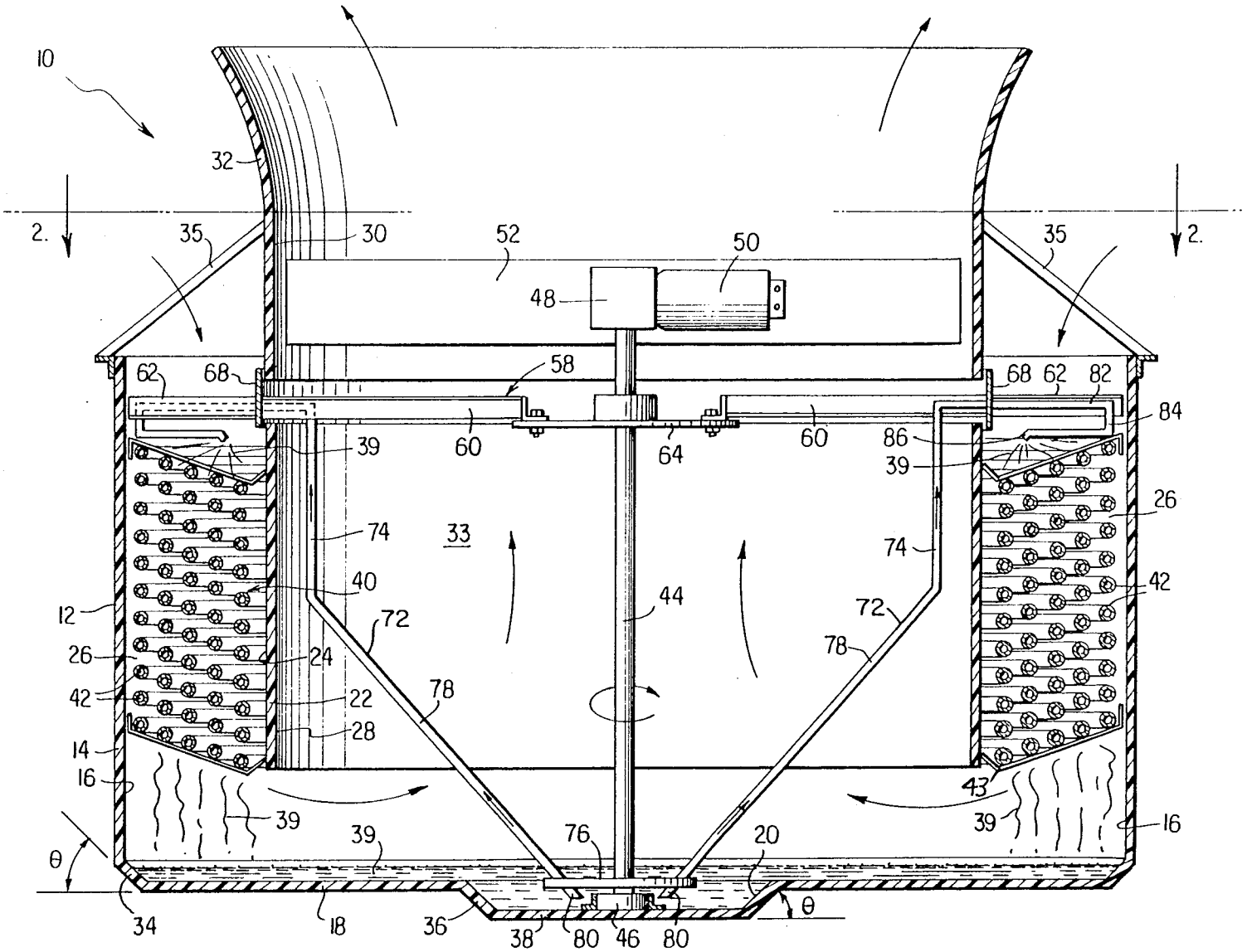

Referring now to the drawings where like characters of reference refer to similar elements in each of the several figures, numeral 10 indicates generally one embodiment of the evaporator heat exchanger of the present invention. The heat exchanger 10 is of the draw through or induced draft type and has an outer casing 12 member usually cylindrical in shape with a vertically extending side wall 14 having an inner surface 16 and a bottom wall 18 integrally formed with said side wall 14. The bottom wall 18 has a recessed sump area 20 formed centrally thereof for receiving water to be recirculated as will be more fully described later. Operation of the device will be described using water although it is to be understood that any other heat transfer medium such as glycol, brine or the like could also be used. The outer casing member 12 is preferably formed of a non-corrosive, rot resistant, plastic-type material such as a polyester resin reinforced with fiber glass.

A cylindrical shaped inner bottom casing member 22 is mounted in a concentric, spaced apart relationship to the outer casing member 12 and has an outer surface 24. The outer surface 24 defines with the inner surface 16 a first chamber 26. The inner bottom casing member 22 also has an inner surface 28 which, together with the inner surface 30 of the inner top casing member 32 defines a second chamber 33. The inner top casing member 32 is supported by brackets 35 connected to outer casing member 12.

The area 34, where the vertically extending side wall 14 and bottom 18 are joined, is tapered at an approximately 45 degree angle—with respect to the bottom wall 18 as is the area 36 of the sump 20 with respect to the bottom 38 of the sump. These areas 34, 36 are so tapered to permit water 39 in the bottom of the outer casing member 12 and sump 20 to ride up the tapered sides in the event of freezing and not expand against the vertically extending side wall 14 causing it to crack and leak.

Figure 2:
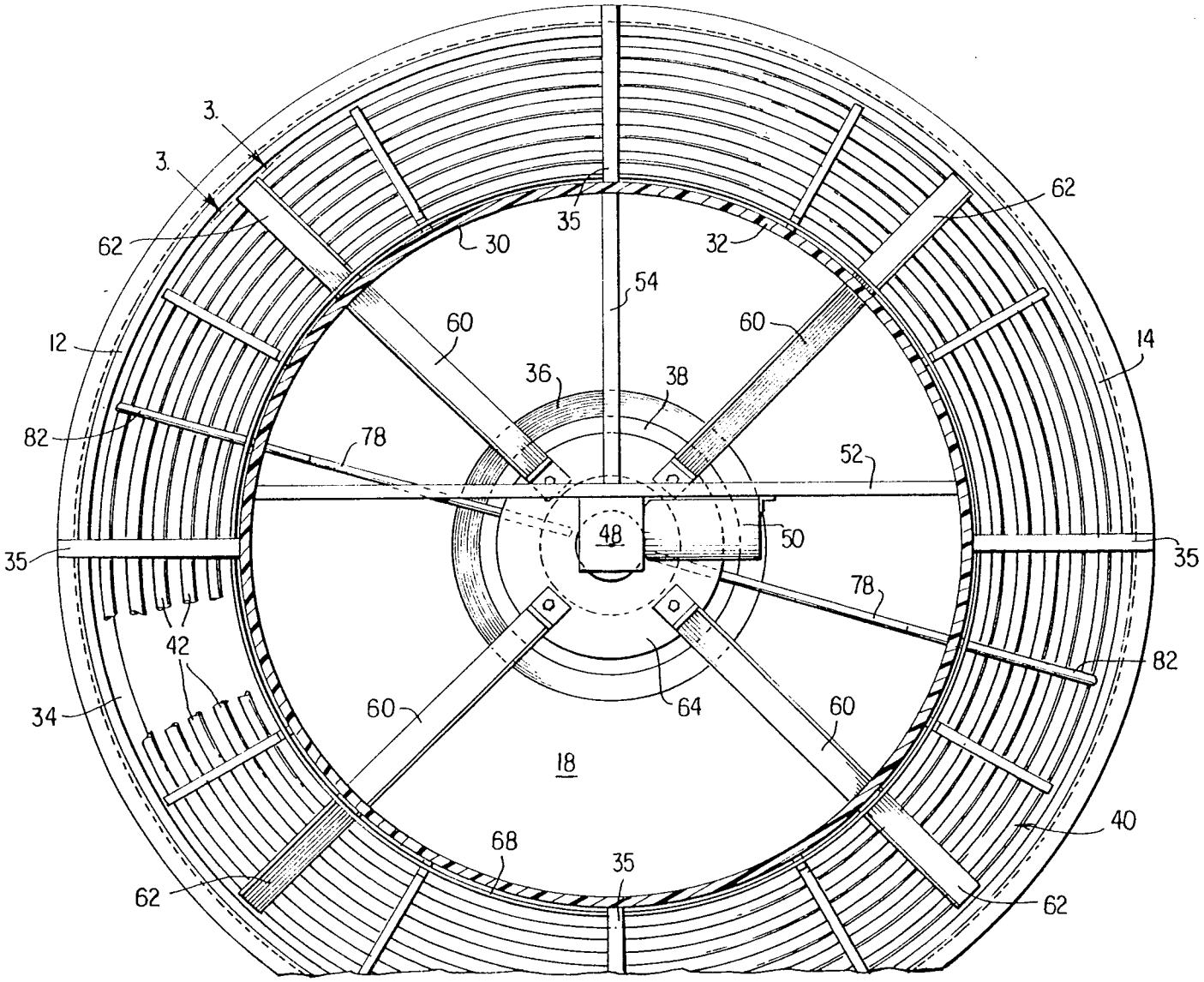

In the embodiment of FIGS. 1 and 2 is a wetted surface in the form of a coil 40 for containing refrigerant or other liquid to be cooled. The coil 40 is positioned in the first chamber 26 between the inner surface 16 and outer surface 24 of inner bottom casing member 26. The coil 40 comprises a plurality of circular loops of tubing 42 (usually continuous) in a plurality of layers innerconnected in the form of a bundle and secured to the inner bottom casing members by brackets 43. Suffice it to say that the coil loops 42 are sufficiently well spaced from each other to permit the easy flow of air and water over and between them. The tubing 42 of coil 40 can have circulated through it a fluid such as water glycol, brine or the like to be cooled by the air and water passing over the outside of the tubing or the tubing can be connected to a conventional refrigeration system (not shown) wherein a refrigerant such as freon is circulated through the tubing to thereby cool only air passing over the outside of the tubing or both air and water passing over the outside of the tubing or both air and water passing over the outside of the tubing.

A shaft 44 is mounted for rotation in the center of the inner top and bottom casing members 22, 32, respectively, at the bottom 38 of the sump 20 by bearing 46 and at the top thereof by gear box 48 driven by an electric motor 50 both of which are secured to cross member 52. The cross member 52 and its bracing member 54 are in turn secured to the inner surface 30 of the inner top casing member 32 and have the dual function of both supporting the gear box 48 and electric motor 50 as well as to serve as a deflection surface for air being drawn up and out of second chamber 33 to arrest its tendancy to swirl in a circular manner by means the rotation of fan 58. The members 52, 54 in effect tend to "straighten out" the flow of air before its discharge from second chamber 33.

Figure 4:
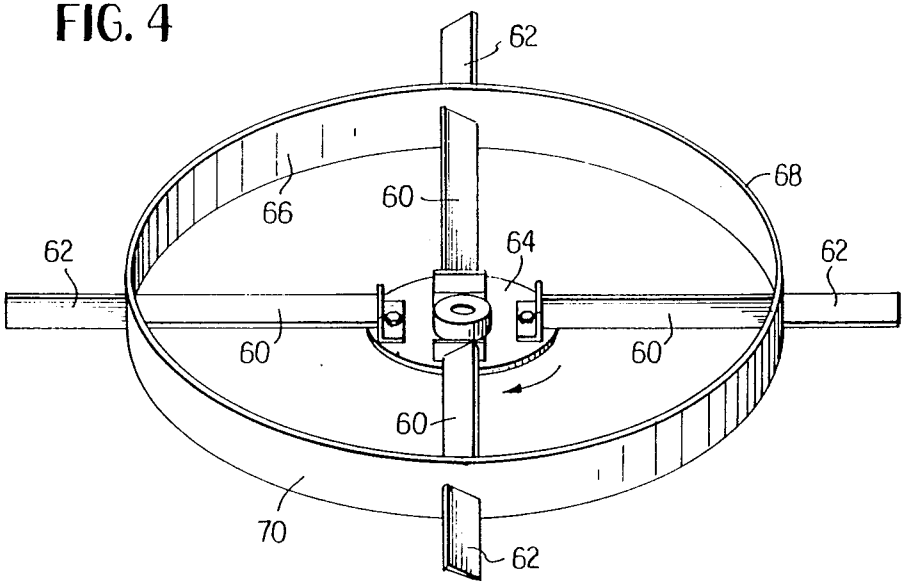
Figure 3:
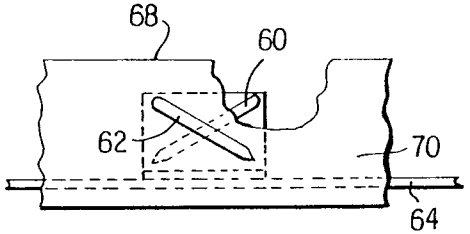

The fan 58, as can be seen by referring to FIGS. 3 and 4, consist of two sets of blades 60,62. The first set of blades 60 are secured at one end to a mounting plate 64 which is secured to and driven by motor 50 and at their other end to the inside surface 66 of a ring 68. The second set of blades 62 extends from and is secured at one of their ends to the outer surface 70 of the ring 68. The ring 68 serves the dual function of preventing air from shipping off of the ends of fan blades 60 as well as providing a closure for the space between the inner top and bottom casing members 32, 22, respectively, to prevent any sprayed water from entering second chamber 33. As can be seen by referring to FIG. 3, the blades 60 of the first set are positioned and mounted at a pitch that is opposite in direction to the direction of the pitch of the blades 62 of the second set. When the fan 58 is mounted by plate 64 on the shaft 44 as can best be seen in FIG. 1, the blades 62 and ring 68 are located in first chamber 26 above the coil 40 where they form the first stage or pushing force when rotated. The blades 60 are located in second chamber 33 between the bottom and top inner casing members 22, 32, respectfully, where they form the second stage or pulling force when rotated with the first stage blades as will now be described.

The first stage fan blades 62 draw air (see arrows) from the atmosphere and push it down over and around the coil loops 42 and through the first chamber 26 around the inner bottom casing member 22 and up into the second chamber 33 whereupon it is engaged by the blades 60 of the second stage which in turn pulls the air up and exhausts it from the inner top casing member 32 back to the atmosphere. Thus, Applicant's novel fan arrangement acts as a two-stage fan and enjoys the added efficiency resulting from the two-stage effect. In addition to the aforementioned advantages for the two-stage effect, Applicant's unique fan design is capable of moving a great quantity of air with slow and quiet rotation of the blades in contrast to the high speed normally required in prior art fans designed to move the same quantity of air with their attendant, comparatively loud noise. Applicant's fan design utilizes the known fact that approximately eighty percent of the work of a typical fan blade is done by the outer end twenty percent of the blade. Thus, for example, if eighty percent of the efficiency of a ten foot in diameter fan blade is in the outer twenty percent or two feet on either end of the blade and this two feet on each end is made the fan blade of the first stage and the remaining six feet [10-(2+2)] of the blade is made the second stage fan blade, then the overall efficiency realized of the first stage fan blade would be eighty percent of the ten foot blade and the second stage would realize the efficiency of one hundred percent of the remaining six foot fan blade.

The air forced into the first chamber by the first stage fan blade flows downward over the coils concurrently with water sprayed or "slung" over the coil loop 42 by means of a centrifugal pump generally designated by reference numeral 72. Applicant's found that by slinging the water there results a greater, more even distribution of the water over the wetted surface than if the water is dripped.

The water 39 is pumped from the sump 20 and returned by gravity to it after flowing over the coil loops 42. The centrifugal pump 72 comprises a plurality of open ended conduits 74 which are disposed about the shaft 44 and secured thereto at their lower end by an apertured collar plate 76. The lower ends 78 of the pump conduits 74 slant downwardly and inwardly from the fan blades 60, 62 to and through the collar plate 76 into the sump 20 and constitute inlets 80 of the centrifugal pump 72. The upper end section 82 of the conduit 74 extends parallel to the bottom 18 and curves backward adjacent the end 82 to form a U-shaped water trap 84 which in turn is connected to an outlet 86. During operation water is, in effect, sucked into the inlets 80 of the conduits 74. Centrifugal force, which is a function of both the rotational speed and the amount of taper of the ends of inlets 80, causes the water to flow up the conduits 74 and into section 82, around trap 84 and then be slung, also by centrifugal force, out outlet 86 over the coil loops 42 toward side wall 14. Because the water rising in the conduits 74 only fills a portion of the conduits during start-up, airflow through the remainder of the conduit would prevent the conduit from filling up to insure the full flow of water if Applicant's trap 84 were not present. Therefore in order to insure that the conduit is filled with water as rapidly as possible, the trap 84 rapidly fills completely with water even during slow rotation thus blocking the passage of air into the conduit and enabling the remainder of the conduit to also fill with water. As can be seen, the water 39 flung from the outlet 86 over the coil loops 42 by the centrifugal pump 72 as aforedescribed is in the same direction as the air flow from the fan blades 62 of the first stage thus reducing the static pressures adjacent these first stage fan blades which themselves rotate with the pump further adding to the efficiency of Applicant's design. The centrifugal pump 72 can be replaced by a separate motor driven pump and rotated by motor means (not shown) separate from the motor and drive means 50, 48 respectively of the fan 58.

It is desired to only cool or heat the air being circulated by the fan 58, then the water or other liquid heat transfer medium can be drained from the sump 20 and the device operated without it or the centrifugal pump 72 and sump 20 can be completely eliminated from the embodiment of FIG. 1. In addition, if no water is being used as aforementioned, the fan 58 can be adapted to draw air in through the second chamber 33 and discharge it through the first chamber 26, for example, by reversing the pitch of the blades 60, 62 from that shown in FIG. 3.

Figure 5:
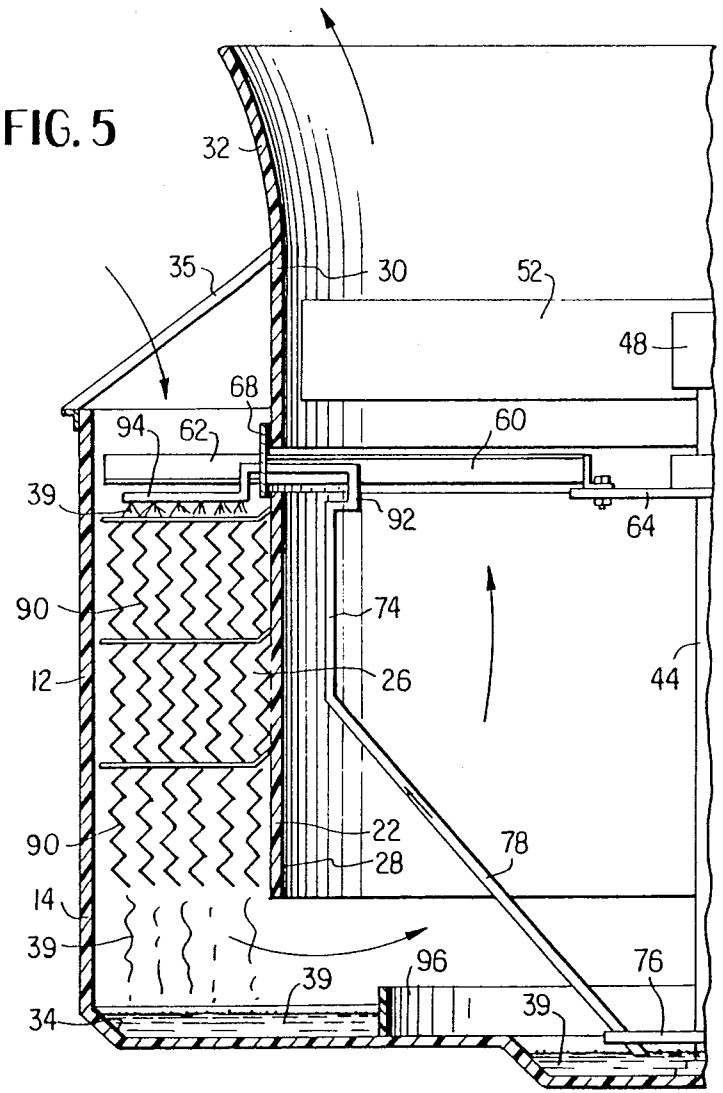

Referring now to FIG. 5 another embodiment of Applicant's device, which is only partially shown for simplicity, it being understood of course that the overall configuration of the device is the same as that of FIG. 1, is disclosed for use in cooling water from an external source (not shown) that has been heated and delivered to the sump 20 of the heat exchanger to be cooled thereby and then returned to the source. In this embodiment, the wetted surface is a plurality of rows of spaced apart plastic sheets 90 mounted in first chamber 26 over which the heated water is centrifugally pumped in the same previously described manner with respect to the embodiment of FIG. 1. The water trap 92 in this embodiment is, however, located at the end of the vertically extending portion of the conduits 74 and serves the same identical function as the trap 84. The water 39 leaving the trap 92 flows horizontally in conduit 94 and is distributed over the plastic sheets 90. The heated water runs down, over and then from the bottom of the plastic sheets 90 into a circular reservoir 96 prior to its being returned therefrom to the source. The air entering the first chamber 26 cools the water as well as the plastic sheets 90. It is to be understood of course that the trap 84 design can be used with the embodiment having plastic sheets 90 or the trap 92 design can be used with the embodiment having the coil loops 42. It should also be pointed out that because the air flow through Applicant's device is slower, any droplets of water in the air are more easily able to fall out of the air into the sump 20 and are less likely to be carried up into the second chamber 33 by the air flow.

Although only a preferred form of the invention has been illustrated, and that form described in detail, it will be apparent to those skilled in the art that various modifications may be made therein without departing from the spirit of the invention or from the scope of the appended claims.

What is claimed is:

1. A heat exchange apparatus for fluids comprising:
(a) an outer casing member having a bottom wall enclosing one end thereof,
(b) an inner casing member having an outer surface spaced from said outer casing and defining with said outer casing a first chamber with an inlet opening at one end and an outlet opening at the other end disposed above said bottom wall, said inner casing member having an inner surface defining a second chamber having an outlet opening and an inlet opening adjacent to the outlet opening of said first chamber,
(c) wetted surface means located in said first chamber, and
(d) fan means superimposed above both said first and second chambers, said fan means having blade means common to both said first and second chambers and capable of simultaneously pushing air into said inlet opening of said first chamber, over said wetted surface means and pulling said air out said outlet opening of said second chamber when rotated.

2. An apparatus as set forth in claim 1 wherein said wetted surface means is a coil containing a fluid to be cooled or heated.

3. An apparatus as set forth in claim 1 wherein said wetted surface means is a plurality of corrugated sheets over which a fluid to be cooled is distributed.

4. An apparatus as set forth in claim 1 wherein said fan means comprises first and second sets of fan blades mounted for rotation in the same direction, said first set of fan blades being positioned at a pitch opposite in direction to the direction of the pitch of said second set of fan blades.

5. An apparatus as set forth in claim 4 wherein said fan blades of said first set have means secured to the ends thereof to prevent the discharge of air from said ends.

6. An apparatus as set forth in claim 5 wherein said means secured to said ends of said blades of said first set is a ring means having an inner surface to which said ends of said blades of said first set are attached and an outer surface to which said blades of said second set are attached.

7. An apparatus as set forth in claim 1 further comprising:
(a) sump means formed in said bottom wall for containing a quantity of a liquid heat transfer medium, and
(b) distribution means including centrifugal pump means extending into said sump means, said pump means including at least one open-ended conduit means having a discharge end adjacent said inlet opening of said first chamber to thereby discharge said medium into said opening and onto said wetted surface means as said fan means rotates.

8. An apparatus as set forth in claim 7 wherein said outer casing member and said bottom wall as well as said sump means have a side wall tapered at an angle with respect to said bottom wall to permit expansion of said medium in the event said medium freezes.

9. An apparatus as set forth in claim 7 wherein said conduit means has trap means formed therein for stopping the flow of air through said conduit means to thereby insure the rapid filling of said conduit means with said medium as said conduit means is rotated.

10. An apparatus as set forth in claim 9 wherein said inner and outer casing members are made of plastic-like material and said distribution means is made of stainless steel.

11. A heat exchange apparatus for fluids comprising:
(a) an outer casing member having a bottom wall enclosing one end thereof, (b) an inner casing member having an outer surface spaced from said outer casing and defining with said outer casing a first chamber with an inlet opening at one end and an outlet opening at the other end disposed above said bottom wall, said inner casing member having an inner surface defining a second chamber having an outlet opening and an inlet opening adjacent to the outlet opening of said first chamber, (c) wetted surface means located in said first chamber, and (d) fan means superimposed above both said first and second chambers, said fan means comprising first and second sets of fan blades mounted for rotation in the same direction said first set of fan blades being positioned at a pitch opposite in direction to the direction of the pitch of said second set of fan blades to simultaneously push air into said inlet opening of said first chamber, over said wetted surface means and pull said air out said outlet opening of said second chamber when rotated.

* * * * *